US005221291A

United States Patent [19]

Imatani et al.

[11] Patent Number: 5,221,291

[45] Date of Patent: Jun. 22, 1993

[54] ABRASIVE SHEET AND PROCESS FOR PRODUCING SAME

[75] Inventors: Katsuo Imatani; Yuji Matsui, both of Ube, Japan

[73] Assignee: Ube Industries, Ltd., Yamaguchi, Japan

[21] Appl. No.: 786,740

[22] Filed: Nov. 1, 1991

[30] Foreign Application Priority Data

Nov. 2, 1990 [JP] Japan ..... 2-295398

[51] Int. Cl.[5] ..... B24D 3/00

[52] U.S. Cl. ..... 51/293; 51/298; 51/308; 51/309

[58] Field of Search ..... 51/293, 298, 308, 309

[56] References Cited

U.S. PATENT DOCUMENTS

| | | | |
|---|---|---|---|
| 3,385,684 | 5/1968 | Voter | 51/298 |
| 3,650,715 | 3/1972 | Brushek et al. | 51/298 |
| 3,651,012 | 3/1972 | Holub et al. | 51/298 |
| 4,221,572 | 9/1980 | Torimae et al. | 51/298 |
| 4,575,384 | 3/1986 | Licht et al. | 51/308 |
| 4,729,771 | 3/1988 | Kunimoto et al. | 51/298 |

FOREIGN PATENT DOCUMENTS 62-74577 9/1985 Japan .

63-237872 3/1987 Japan .

OTHER PUBLICATIONS

World Patents Index Latest, Sec. Ch. Week 8935, Derwent Publications, Ltd., p. 29, Oct. 11, 1989.

Patent Abstracts of Japan, vol. 13, No. 469, (M-883) (3817).

*Primary Examiner*—Mark L. Bell

*Assistant Examiner*—Willie J. Thompson

*Attorney, Agent, or Firm*—Finnegan, Henderson, Farabow, Garrett and Dunner

[57] ABSTRACT

An abrasive sheet having a high flexibility, mechanical strength and heat resistance, comprises (A) a matrix comprising an aromatic polyimide resin and (B) abrasive grains having an average size of 65–150 μm and evenly dispersed in an amount of 2 to 50% by weight in the matrix, and is produced by forming a thin liquid layer from a dispersion comprising an aromatic polyamic acid solution with a rotation viscosity of 3000 to 6000 poises at 30° C. and the above-mentioned abrasion grains dispersed in the solution, and dry-solidifying the liquid layer of the dispersion while imidizing the aromatic polyamic acid to a corresponding aromatic polyimide, the abrasive sheet having a thickness of 1.1 to 3.0 times the average size of the abrasive grains.

22 Claims, 1 Drawing Sheet

ABRASIVE SHEET AND PROCESS FOR PRODUCING SAME

BACKGROUND OF THE INVENTION

1) Field of the Invention

The present invention relates to an abrasive sheet and a process for producing the same. More particularly, the present invention relates to an abrasive sheet which is flexible and contains abrasive grains having a relatively large average size and uniformly dispersed in a matrix comprising an aromatic polyimide resin, and a process for producing the same.

The abrasive sheet of the present invention is employed directly or by being attached to a base of an abrading or grinding tool, to abrade or polish a surface of a hard material, or to grind or cut an inorganic or metallic material.

2) Description of the Related Arts

It is known that a flexible emery sheet is composed of a base sheet consisting of a paper sheet or cloth and abrasive grains bounded to the base sheet with a bonding agent. This conventional abrasive sheet has an unsatisfactory mechanical strength, heat resistance and abrasion property, due to the properties of the base sheet and the bonding agent, and thus is not adequate, as an industrial abrasive tool, for hard materials which resist abrasion.

U.S. Pat. Nos. 3,385,684 and 3,650,715 disclose a heat-resistant abrasive tool for super hard alloy materials. This abrasive tool is prepared by mixing a bonding agent consisting of a finely divided aromatic polyimide produced by a polymerization of pyromellitic dianhydride with an aromatic diamine, and abrasive grains consisting of diamond; molding the resultant mixture in a mold under high-temperature high-pressure conditions to provide a annular-shaped abrasive material; and bonding the annular-shaped abrasive material to a wheel-shaped base of an abrading or grinding tool, to form an abrasive grain layer.

In this conventional method, in which the abrasive material is produced by a powder-molding method, it is difficult to industrially produce an abrasive sheet having a small thickness, a high flexibility and an excellent heat-resistance.

Japanese Unexamined Patent Publication Nos. 62-74,577 and 63-237,892 disclose a flexible abrasive sheet comprising a matrix comprising an aromatic polyimide and abrasive grains having a small average size of 60 μm or less uniformly dispersed in the matrix.

Nevertheless, this conventional abrasive sheet does not always have a satisfactory abrading or grinding property thereof.

SUMMARY OF THE INVENTION

An object of the present invention is to provide an abrasive sheet having a satisfactory mechanical strength and heat resistance and an excellent abrading or grinding property, and a process for producing the abrasive sheet at a high efficiency.

The above-mentioned object can be attained by the abrasive sheet and the process of the present invention.

The abrasive sheet of the present invention comprises (A) a matrix comprising an aromatic polyimide resin which is a polymerization-imidization product of an aromatic tetracarboxylic acid component with an aromatic diamine component; and (B) abrasive grains having an average size of from 65 μm to 150 μm and uniformly dispersed in an amount of 2 to 50% by weight in the aromatic polyimide resin matrix; the abrasive sheet having a thickness of from 1.1 to 3.0 times the average size of the abrasive grains.

The process of the present invention for producing the abrasive sheet comprises the steps of:

uniformly dissolving an aromatic polyamic acid, which is a polymerization product of an aromatic tetracarboxylic acid component with an aromatic diamine component, in an organic polar solvent, to prepare an aromatic polyamic acid solution having a rotation viscosity of from 3000 to 6000 poises at a temperature of 30° C.;

uniformly mixing the aromatic polyamic acid solution with abrasive grains having an average size of 65 μm to 150 μm, in an amount of 2 to 50% based on the total dry weight of the aromatic polyamic acid solution and the abrasive grains, to provide a dispersion;

subjecting the dispersion to a film-forming procedure in which a liquid layer is formed from the dispersion and then dry-solidified while imidizing the aromatic polyamic acid to a corresponding aromatic polyimide, to provide an abrasive sheet having a thickness of 1.1 to 3.0 times the average size of the abrasive grains.

DESCRIPTION OF THE PREFERRED EMBODIMENTS

Figure 1:
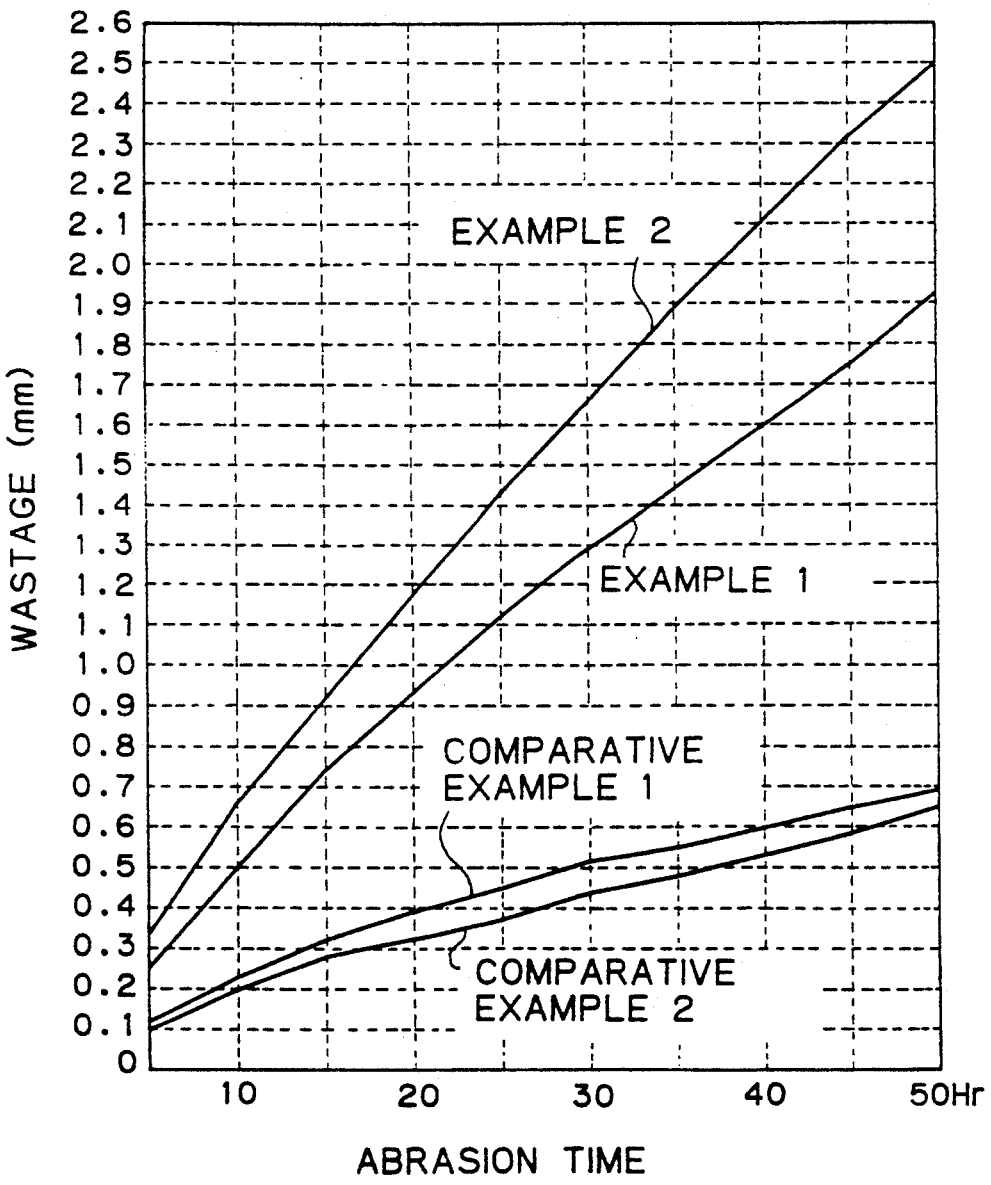
FIG. 1 is a graph showing the relationships between the number of abrading operations and the wear of the aluminum oxide rods in Examples 1 and 2 and Comparative Examples 1 and 2.

The abrasive sheet of the present invention comprises (A) an aromatic polyimide resin matrix and specific abrasive grains uniformly dispersed in the matrix.

The abrasive grains usable for the present invention have an average size of from 65 μm to 150 μm, preferably from 65 μm to 125 μm. The abrasive grains can be selected from those usable for grinding, abrading, and cutting. For example, natural and artificial diamond grains and boron nitride grains are usable as the abrasive grains for the present invention.

The abrasive grains may have coating layers covering the entire surfaces of the grains and comprising an inorganic or metallic substance, for example, copper or nickel-coated natural and artificial diamond grains.

The aromatic polyimide resin usable for providing a matrix of the abrasive sheet is a polymerization-imidization product of an aromatic tetracarboxylic acid component and an aromatic diamine component, in substantially equimolar amounts.

The aromatic tetracarboxylic acid component preferably comprises at least one member selected from the group consisting of biphenyltetracarboxylic acids, for example, 2,3,3',4'-biphenyltetracarboxylic acid and 3,3',4,4'-biphenyltetracarboxylic acid; pyromellitic acid, benzophenonetetracarboxylic acids, for example, 3,3',4,4'-benzophenonetetracarboxylic acids, and dianhydrides of the above-mentioned acid.

The aromatic diamine component preferably comprises at least one member selected from the group consisting of 4,4'-diaminodiphenylether, 3,4'-diaminodiphenylether, 4,4'-diaminodiphenylthioether, 4,4'-diaminodiphenylsulfone, 4,4'-diaminobenzophenone, 4,4'-diaminodiphenylmethane, 2,2'-bis(4-aminophenyl) propane and o-, m- and p-phenylenediamines.

The aromatic tetracarboxylic acid component and the aromatic diamine component are polymerized and imidized. The resultant aromatic polyimide resin exhibits an excellent heat resistance and mechanical strength, and a satisfactory flexibility.

Preferably, the aromatic polyimide resin exhibits a heat resistance represented by a weight reduction temperature of 450° C. or more, more preferably 500° C. or more. The weight reduction temperature is determined in such a manner that the aromatic polyimide resin specimen is heated at a temperature-raising rate of 10° C./min while measuring the weight of the heated resin specimen, and when the weight reduction of the resin specimen reaches 5% based on the initial weight of the resin specimen, the temperature of the resin specimen is measured. Where a biphenyltetracarboxylic acid compound is used as the aromatic tetracarboxylic acid component, the resultant aromatic polyimide resin preferably has a logarithmic viscosity number of about 0.1 to 7, more preferably 0.3 to 5, determined in a concentration of 0.5 g/100 ml in a solvent consisting of p-chlorophenol at a temperature of 50° C.

In an preferable embodiment of the present invention, the aromatic polyimide resin having a high molecular weight is prepared by a polymerization-imidization of an aromatic tetracarboxylic acid component comprising 50 molar % or more, more preferably 60 molar % or more, still more preferably 80 to 100 molar %, of 3,3',4,4'-biphenyltetracarboxylic acid or anhydride and 50 molar % or less, more preferably 40 molar % or less, still more preferably 0 to 20 molar %, of at least one other aromatic tetracarboxylic acid or anhydride, and an aromatic diamine component comprising 50 molar % or more, more preferably 60 molar % or more, still more preferably 80 to 100 molar % of 4,4'-diaminodiphenylether and 50 molar % or less, more preferably 40 molar % or less, still more preferably 0 to 20 molar %, of at least one other aromatic diamine, in substantially equimolar amounts.

The other aromatic tetracarboxylic acid or dianhydride is, for example, 2,3,3',4'-biphenyltetracarboxylic acid or dianhydride, pyromellitic acid or dianhydride, and 3,3',4,4'-benzophenonetetracarboxylic acid or dianhydride.

The other aromatic diamine is, for example, 3,4'-diaminodiphenylether or 4,4'-diaminodiphenylsulfone.

This type of aromatic polyimide resin with a high molecular weight has an excellent heat resistance, durability and mechanical properties and can firmly hold the abrasive grains, and thus exhibits superior abrading and grinding properties.

In another preferable embodiment of the present invention, the aromatic polyimide resin having a high molecular weight is prepared by the polymerization-imidization of an aromatic tetracarboxylic acid component comprises 50 molar % or more, more preferably 60 molar % or more, still more preferably 80 to 100 molar %, of 3,3',4,4'-biphenyltetracarboxylic acid or dianhydride and 50 molar % or less, more preferably 40 molar % or less, still more preferably 0 to 20 molar % of at least one other aromatic tetracarboxylic acid or dianhydride, and an aromatic diamine component comprises 40 molar % or more, more preferably 50 molar % or more, still more preferably 60 to 100 molar %, of at least one member selected from the group consisting of o-, m- and p-phenylenediamines and 60 molar % or less, more preferably 50 molar % or less, still more preferably 0 to 40 molar %, of at least one other aromatic diamine, in substantially equimolar amounts.

The other aromatic tetracarboxylic acid is, for example, 2,3,3'4'-biphenyltetracarboxylic acid, pyromellitic acid, or 3,3',4,4'-benzophenonetetracarboxylic acid, and the other aromatic diamine is, for example, 4,4'-diaminobenzophenone, 4,4'-diaminodiphenylmethane, 4,4'-diaminodiphenylether or 4,4'-diaminodiphenylthioether.

This type of aromatic polyimide resin with a high molecular weight has excellent mechanical properties, durability and heat resistance. Especially, this type of aromatic polyimide resin exhibits an enhanced thermal dimensional stability, i.e., a low thermal coefficient of expansion of about 1.2 to $4.0\times10^{-5}$ cm/cm/°C. at a temperature of from room temperature to 300° C., and thus can be used for the present invention.

The abrasive sheet of the present invention optionally contains a filler comprising at least one member selected from the group consisting of $SiO_2$, SiC, $Al_2O_3$, $FeO_3$, Cu and Sn in an amount of 0.1 to 60% based on the weight of the matrix.

Preferably, the filler has an average size of from 0.1 to 100 μm, more preferably from 0.5 to 50 μm.

To import an excellent abrading or grinding property to the abrasive sheet, the abrasive grains must be contained in an amount of 2 to 50% by weight, preferably 5 to 40% by weight in the abrasive sheet, and the abrasive sheet must have a thickness of 1.1 to 3.0 times, preferably 1.2 to 3.0 times, the average size of the abrasive grains.

Further, the abrasive sheet of the present invention optionally contains a coupling agent comprising at least one trialkoxysilane compound in an amount of 0.01 to 5%, preferably 0.05 to 3%, based on the weight of the aromatic polyimide resin matrix.

The trialkoxysilane compound is preferably selected from α-N-phenylaminopropyl-tri-methoxysilane, γ-aminopropyl-trimethoxysilane, vinyl-triethoxysilane, vinyl-tris(2-methoxyethoxy)silane, β-(3,4-epoxycyclohexyl)ethyl-trimethoxysilane and γ-glycidoxypropylmethoxysilane.

The silane coupling agent added to the aromatic polyimide resin effectively enhances the abrading or grinding property of the resultant abrasive sheet.

In the process of the present invention for producing the abrasive sheet, an aromatic polyamic acid prepared from the above-mentioned aromatic tetracarboxylic acid and diamine components is uniformly dissolved in an organic polar solvent, to prepare a solution of an aromatic polyamic acid which is a precursor of the aimed aromatic polyimide resin. The viscosity of the aromatic polyamic acid must be controlled to a rotation viscosity of 3000 to 6000 poises, preferably 3200 to 5000 poises, at a temperature of 30° C. The aromatic polyamic acid preferably has a high molecular weight of 15,000 to 500,000.

Then, the aromatic polyamic acid solution is uniformly mixed with abrasive grains having an average size of 65 μm to 150 μm, in an amount of 2 to 50% based on the total dry weight of the aromatic polyamic acid solution and the abrasive grains, to provide a uniform dispersion of the abrasive grains in the aromatic polyamic acid solution.

When the aromatic polyamic acid solution has a rotation viscosity of less than 3000 poises, it becomes difficult to uniformly disperse the abrasive grains having the above-mentioned relatively large average size in the aromatic polyamic acid solution, and thus the abrasive grains are sometimes locally distributed in one side of a surface of the resultant abrasive sheet and the resultant abrasive sheet exhibits a strong curling property and occasionally rolls up into the form of a cylinder.

Also, if the rotation viscosity is more than 6000 poises, the abrasive grains are unevenly dispersed in the aromatic polyamic acid solution, and thus the resultant abrasive sheet exhibits a poor mechanical strength; occasionally it becomes impossible to form a sheet from the mixture of the aromatic polyamic acid solution with the abrasive grains.

The organic polar solvent usable for the preparation of the aromatic polyamic acid solution preferably comprises at least one member selected from the group consisting of amide compounds, for example, N-methylpyrrolidone, N,N-dimethylformamide, N,N-diethylformamide, N,N-dimethylacetamide, N,N-diethylacetamide, and phenol compounds, for example, phenol, cresol and halogenated phenol compounds, for example, p-chlorophenol, m-chlorophenol, and 2,4-dichlorophenol.

The dispersion of the abrasive grains in the aromatic polyamic acid solution is formed into a liquid layer, and the dispersion liquid layer is dry-solidified while imidizing the aromatic polyamic acid to a corresponding aromatic polyimide, to provide an abrasive sheet.

The thickness of the liquid dispersion layer is controlled to an extent such that, after the dry-solidifying and imidizing step, the resultant abrasive sheet has a thickness of 1.1 to 3.0 times the average size of the abrasive grains.

Optionally, the aromatic polyamic acid solution is supplemented with the above-mentioned coupling agent in an amount of 0.01 to 5%, preferably 0.05 to 3% based on the dry weight of the aromatic polyamic acid solution.

Preferably, the abrasive grains are dispersed in an amount of about 1 to 30%, more preferably 3 to 20%, based on the weight of the aromatic polyamic acid solution.

The mixing and dispersing step of the abrasive grains in the aromatic polyamic acid solution can be effected by any customary method.

In the preparation of the aromatic polyamic acid solution, the aromatic polyamic acid preferably has a logarithmic viscosity number of from 0.1 to 7, more preferably 0.3 to 5, determined at a concentration of 0.5 g/100 ml in N,N-dimethylacetamide at a temperature of 30° C., and is present in a concentration of about 3 to 50% by weight, more preferably 5 to 30% by weight, in the solution. This aromatic polyamic acid solution contributes to the formation of a uniform thin liquid layer of the resultant dispersion.

As mentioned above, the dispersion optionally contains the above-mentioned filler.

The formation of the liquid layer of the dispersion can be effected by a conventional continuous or intermittent film-forming method, for example, a liquid-spreading method in which the dispersion is spread on a smooth surface of a shaping base, for example, a glass plate, a metallic drum or a metallic belt, at a film-forming temperature of about 5° C. to 120° C., preferably 10° C. to 60° C., to form a liquid layer having a uniform thickness of, for example, 100 to 1,000 μm.

In the process of the present invention, the liquid dispersion layer on the shaping base is dry-solidified under the ambient atmospheric pressure or a reduced pressure, optionally in an inert gas atmosphere, and if necessary by heating at a temperature of from about 50° C. to 150° C. The solidified sheet, if necessary after peeling from the shaping base, is heated at a temperature of about 100° C. to 500° C., preferably, 200° C. to 500° C. in a heating oven, to completely remove residual solvent in the sheet, imidize the aromatic polyamic acid, and heat-treat the resultant abrasive sheet.

In this process of the present invention, the abrasive grains are firmly held in and fixed to the aromatic polyimide resin matrix, and an abrasive sheet having an excellent heat resistance, mechanical strength, durability and abrading and grinding property, and a satisfactory flexibility, is continuously or intermittently produced at an excellent industrial reproductivity.

EXAMPLES

The present invention will be further explained by the following examples.

EXAMPLE 1

An aromatic polyamic acid having a logarithmic viscosity number of 1.56 determined at a concentration of 0.5 g/100 ml in N,N-dimethyl acetamide at a temperature of 30° C. was prepared by the polymerization of 4,4'-diaminodiphenylether with 3,3',4,4'-biphenyltetracarboxylic dianhydride.

A solution of the polyamic acid prepared in a concentration of 18% by weight in a solvent consisting of N,N-dimethyl acetamide had a rotation viscosity of 3500 poises at a temperature of 30° C.

A film-forming dope dispersion was prepared by uniformly mixing 4.5 g of diamond abrasive grains having an average size of 70 μm in 100 ml of the aromatic polyamic acid solution.

The dispersion was spread on a surface of a glass plate, by hand-coating using an applicator, to form a liquid layer having a uniform thickness.

This liquid dispersion layer was dry-solidified under a vacuum by evaporating away a portion of the solvent while raising the temperature of the layer from about 25° C. to 90° C. A solidified sheet containing a residual solvent in an amount of about 30% by weight was obtained. This sheet was released from the glass plate, fixed to a pin tenter and placed in a heating furnace in which hot air was blown. The sheet was completely dried and heat-treated in the furnace, at a temperature of 300° C. to 450° C. for 20 minutes, while completely imidizing the aromatic polyamic acid.

The resultant abrasive sheet had a uniform thickness of 90 μm and contained the abrasive grains in an amount of 20% by weight.

The abrasive sheet was subjected to an abrasion test in which an abrasion tester having an abrasion disc having a diameter of 8 inches (203.2 mm) and rotatable at a rotation number of 60 r.p.m, was used and an aluminum oxide rod having a diameter of 7 mm and a length of 3 mm was ground. The test result is shown in FIG. 1.

In this abrasion test, the ground aluminum oxide rod had a surface roughness $R_{max}$ of 3.7 μm. Note, the smaller the $R_{max}$, the higher the surface smoothness.

The tensile strength, ultimate elongation, thermal weight reduction (at a temperature of from 0° C. to 500° C.), and equilibrium moisture regain at a temperature of 50° C. and a relative humidity of 50%, of the abrasion sheet were measured, and the results are shown in Table 1.

EXAMPLE 2

The same procedures as in Example 1 were carried out, with the following exceptions.

The aromatic polyamic acid had a logarithmic viscosity number of 1.86 determined in the same manner as mentioned above.

The diamond abrasive grain dispersion contained the aromatic polyamic acid in a concentration of 18% by weight and had a rotation viscosity of 4000 poises at 30° C.

The resultant abrasion sheet had a thickness of 100 μm.

The abrasion test result is shown in FIG. 1.

The ground aluminum oxide rod had a surface roughness $R_{max}$ of 3.9 μm.

The results of the same measurements as in Example 1 are also shown in Table 1.

TABLE 1

| Item | Example No. | |
|---|---|---|
| | Example 1 | Example 2 |
| Tensile strength (kg/mm$^2$) | 8.8 | 8.2 |
| Ultimate elongation (%) | 7 | 6 |
| Thermal weight reduction (from 0° C. to 500° C.) (%) | 2.4 | 2.6 |
| Equilibrium moisture regain (%) (50° C., 50% RH) | 0.9 | 0.9 |

COMPARATIVE EXAMPLE 1

The same procedures as in Example 1 were carried out with the following exceptions.

The diamond abrasive grains had an average size of 50 μm.

The diamond abrasive grain dispersion contained the aromatic polyamic acid having a logarithmic viscosity number of 1.86 at 30° C. in a concentration of 18% by weight, and had a rotation viscosity of 2000 poises at 30° C.

The abrasion test result is shown in FIG. 1.

The ground aluminum oxide rod had a surface roughness $R_{max}$ of 3.6 μm.

COMPARATIVE EXAMPLE 2

The same procedures as in Comparative Example 1 were carried out, except that the diamond abrasive grains had an average size of 35 μm.

The abrasion test result is shown in FIG. 1.

The ground aluminum oxide rod had a surface roughness $R_{max}$ of 3.6 μm.

COMPARATIVE EXAMPLE 3

The same procedures as in Example 1 were carried out, with the following exceptions.

The polyamic acid has a logarithmic viscosity number of 1.86 determined in the same manner as mentioned above.

The diamond abrasive grain dispersion contained the aromatic polyamic acid in a concentration of 20% by weight and had a rotation viscosity of 4,000 poises at 30° C.

The resultant abrasive sheet exhibited a strong curling property. Namely, the abrasive sheet rolled up at a curvature radius of 15 mm, and thus was practically useless.

The abrasion test was not applied to the abrasive sheet.

As the examples clearly indicate, in the abrasive sheet of the present invention, the abrasive grains having a large average size are uniformly distributed in and firmly fixed by the aromatic polyimide resin matrix.

Therefore, the abrasive sheet of the present invention exhibits an excellent mechanical strength, heat resistance and chemical resistance, a superior grinding property at a high speed, and a good durability at a high temperature, and further, a satisfactory flexibility. Also, the resultant ground material exhibits a high surface smoothness.

Further, the process of the present invention enables the above-mentioned abrasive sheet to be industrially produced at a high reproductivity.

We claim:

1. An abrasive sheet comprising (A) a matrix comprising an aromatic polyimide resin which is a polymerization-imidization product of an aromatic tetracarboxylic acid component with an aromatic diamine component; and (B) abrasive grains having an average size of from 65 μm to 150 μm and uniformly dispersed in an amount of 2 to 50% by weight in the aromatic polyimide resin matrix, said abrasive sheet having a thickness of from 1.1 to 3.0 times the average size of the abrasive grains.

2. The abrasive sheet as claimed in claim 1, wherein the abrasive grains comprise a member selected from the group consisting of natural and artificial diamond and cubic crystalline boron nitride.

3. The abrasive sheet as claimed in claim 1, wherein the aromatic tetracarboxylic acid component comprises at least one member selected from the group consisting of biphenyltetracarboxylic acids, pyromellitic acid, benzophenonetetracarboxylic acids, and dianhydrides of the above-mentioned acids.

4. The abrasive sheet as claimed in claim 1, wherein the aromatic diamine component comprises at least one member selected from the group consisting of 4,4'-diaminodiphenylether, 3,4'-diaminodiphenylether, 4,4'-diaminodiphenylthioether, 4,4'-diaminodiphenylsulfone, 4,4'-diaminobenzophenone, 4,4'-diaminodiphenylmethane, 2,2'-bis(4-aminophenyl) propane and o-, m- and p-phenylenediamines.

5. The abrasive sheet as claimed in claim 1, wherein the aromatic tetracarboxylic acid component comprises 50 molar % or more of 3,3',4,4'-biphenyltetracarboxylic acid or anhydride and 50 molar % or less of at least one other aromatic tetracarboxylic acid or anhydride, and the aromatic diamine component comprises 50 molar % or more of 4,4'-diaminodiphenylether and 50 molar % or less of at least one other aromatic diamine, in substantially equimolar amounts.

6. The abrasive sheet as claimed in claim 1, wherein the aromatic tetracarboxylic acid component comprises 50 molar % or more of 3,3',4,4'-biphenyltetracarboxylic acid or dianhydride and 50 molar % or less of at least one other aromatic tetracarboxylic acid or dianhydride, and the aromatic diamine component comprises 40 molar % or more of at least one member selected from the group consisting of o-, m- and p-phenylenediamines and 60 molar % or less of at least one other aromatic diamine, in substantially equimolar amounts.

7. The abrasive sheet as claimed in claim 1, which further contains a filler comprising at least one member selected from the group consisting of $SiO_2$, SiC, $Al_2O_3$, $FeO_3$, Cu and Sn in an amount of 0.1 to 60% based on the weight of the matrix.

8. The abrasive sheet as claimed in claim 7, wherein the filler has an average particle size of from 0.1 to 100 μm.

9. The abrasive sheet as claimed in claims 1 or 7, which further contains a coupling agent comprising at least one trialkoxysilane compound in an amount of 0.01 to 5% based on the weight of the matrix.

10. A process for producing an abrasive sheet comprising the steps of:

uniformly dissolving an aromatic polyamic acid, which is a polymerization product of an aromatic tetracarboxylic acid component with an aromatic diamine component, in an organic polar solvent, to prepare an aromatic polyamic acid solution having a rotation viscosity of from 3000 to 6000 poises at a temperature of 30° C.;

uniformly mixing the aromatic polyamic acid solution with abrasive grains having an average size of 65 μm to 150 μm, in an amount of 2 to 50% based on the total dry weight of the aromatic polyamic acid solution and the abrasive grains, to provide a dispersion;

subjecting the dispersion to a film-forming procedure in which a liquid layer is formed from the dispersion and then dry-solidified while imidizing the aromatic polyamic acid to a corresponding aromatic polyimide, to provide an abrasive sheet having a thickness of 1.1 to 3.0 times the average size of the abrasive grains.

11. The process as claimed in claim 10, wherein the organic polar solvent comprises at least one member selected from the group consisting of N-methylpyrrolidone, N,N-dimethylformamide, N,N-diethylformamide, N,N-dimethylacetamide, N,N-diethylacetamide, phenol, cresol and halogenated phenol compounds.

12. The process as claimed in claim 10, wherein the abrasive grains comprises a member selected from the group consisting of natural and artificial diamond and cubic crystalline boron nitride.

13. The process as claimed in claim 10, wherein the aromatic tetracarboxylic acid component comprises at least one member selected from the group consisting of biphenyltetracarboxylic acids, pyromellitic acid, benzophenonetetracarboxylic acids, and dianhydrides of the above-mentioned acids.

14. The process as claimed in claim 10, wherein the aromatic diamine component comprises at least one member selected from the group consisting of 4,4'-diaminodiphenylether, 3,4'-diaminodiphenylether, 4,4'-diaminodiphenylthioether, 4,4'-diaminodiphenylsulfon, 4,4'-diaminobenzophenone, 4,4'-diaminodiphenylmethane, 2,2'-bis(4-aminophenyl)propane and o-, m- and p-phenylenediamines.

15. The process as claimed in claim 10, wherein the aromatic tetracarboxylic acid component comprises 50 molar % or more of 3,3',4,4'-biphenyltetracarboxylic acid or dianhydride and 50 molar % or less of at least one other aromatic tetracarboxylic acid or dianhydride, and the aromatic diamine component comprises 50 molar % or more of 4,4'-diaminodiphenylether and 50 molar % or less of at least one other aromatic diamine, in equimolar amounts.

16. The process as claimed in claim 10, wherein the aromatic tetracarboxylic acid component comprises 50 molar % or more of 3,3',4,4'-biphenyltetracarboxylic acid or dianhydride and 50 molar % or less of at least one other aromatic tetracarboxylic acid or dianhydride, and the aromatic diamine component comprises 40 molar % or more of at least one member selected from the group consisting of o-, m- and p-phenylenediamines and 60 molar % or less of at least one other aromatic diamine, in equimolar amounts.

17. The process as claimed in claim 10, wherein the dispersion further contains a filler comprising at least one member selected from the group consisting of $SiO_2$, SiC, $Al_2O_3$, $FeO_3$, Cu and Sn, in an amount of 0.1 to 60% based on the total weight of the resultant abrasive sheet.

18. The process as claimed in claim 17, wherein the filler has an average particle size of from 0.1 to 100 μm.

19. The process as claimed in claim 10, wherein the aromatic polyamic acid solution is further mixed with a coupling agent comprising at least one trialkoxysilane compound in an amount of 0.01 to 5% based on the dry weight of the aromatic polyamic acid solution.

20. The process as claimed in claim 10, wherein the aromatic polyamic acid has a logarithmic viscosity number of from 0.1 to 7 determined at a concentration of 0.5 g/100 ml in N,N-dimethylacetamide at a temperature of 30° C.

21. The process as claimed in claim 10, wherein the aromatic polyamic acid is present in a concentration of 3 to 50% by weight in the solution thereof.

22. The process as claimed in claim 10, wherein in the film-forming procedure, the dispersion is formed into the liquid layer at a temperature of from 5° C. to 120° C., the liquid layer is dry-solidified at a temperature of from 50° C. to 150° C. and the resultant dry-solidified sheet is heat-treated at a temperature of from 100° C. to 500° C. to completely remove the solvent from the sheet and to imidize the aromatic polyamic acid.

* * * * *